US007845295B2

(12) United States Patent
Park

(10) Patent No.: US 7,845,295 B2
(45) Date of Patent: Dec. 7, 2010

(54) SEWING ARM MECHANISM OF EMBROIDERY MACHINE

(75) Inventor: Chan Soo Park, Seoul (KR)

(73) Assignee: Sunstar Precision Co., Ltd, Incheon (KR)

( * ) Notice: Subject to any disclaimer, the term of this patent is extended or adjusted under 35 U.S.C. 154(b) by 560 days.

(21) Appl. No.: 11/858,172

(22) Filed: Sep. 20, 2007

(65) Prior Publication Data

US 2008/0168934 A1 Jul. 17, 2008

(30) Foreign Application Priority Data

Jan. 17, 2007 (KR) ..... 10-2007-0005458
Apr. 24, 2007 (KR) ..... 10-2007-0039880

(51) Int. Cl.
*D05B 69/30* (2006.01)
*D05B 69/00* (2006.01)

(52) U.S. Cl. ..... 112/220

(58) Field of Classification Search ..... 112/98–101, 112/117, 80.4–80.45, 220, 221, 235–239
See application file for complete search history.

(56) References Cited

U.S. PATENT DOCUMENTS 3,605,660 A * 9/1971 Short ..... 112/80.73
3,749,037 A * 7/1973 Cash ..... 112/117
4,006,696 A * 2/1977 Robertson ..... 112/117
4,006,697 A * 2/1977 Robertson ..... 112/118
4,515,096 A * 5/1985 Ingram ..... 112/80.42
4,669,403 A * 6/1987 Bagnall ..... 112/80.4
5,331,909 A * 7/1994 Tajima et al. ..... 112/103
6,170,414 B1 * 1/2001 Kaetterhenry et al. ..... 112/117
7,143,705 B2 * 12/2006 Frazer et al. ..... 112/117

FOREIGN PATENT DOCUMENTS

JP 6-134164 A 5/1994

OTHER PUBLICATIONS

Taiwanese Office Action for Taiwanese Patent Application No. 096137358 which corresponds to U.S. Appl. No. 11/858,172.

* cited by examiner

*Primary Examiner*—Ismael Izaguirre
(74) *Attorney, Agent, or Firm*—LRK Patent Law Firm

(57) ABSTRACT

Disclosed is a sewing arm mechanism of an embroidery machine. Within the sewing arm mechanism, there are provided a needle bar vertical drive unit and cloth pressing member vertical drive unit for vertically moving a needle bar and a cloth pressing member, respectively, by using the rotational driving force of an upper shaft. The sewing arm mechanism is configured in such a manner that the needle bar drive reaction force exerted on the upper shaft by the driving the needle bar vertical drive unit, and the cloth pressing member drive reaction force exerted on the upper shaft by the driving of the cloth pressing member vertical drive unit act in opposite directions of each other, whereby the magnitudes of the reaction forces exerted on the upper shaft can be cancelled with each other.

1 Claim, 16 Drawing Sheets

SEWING ARM MECHANISM OF EMBROIDERY MACHINE

FIELD

The present disclosure relates to an embroidery machine, and in particular, to a sewing arm mechanism of an embroidery machine which is configured in such a manner that reaction forces, exerted on an upper shaft of the embroidery machine when a needle bar vertical drive unit and a cloth pressing member (so-called "presser foot") drive unit are driven, act in opposite directions of each other, so that the needle bar vertical drive unit and the cloth pressing member drive unit, both of which are driven by using the rotational driving force of the upper shaft, can be driven in high speed within the sewing arm of the embroidery machine so as to improve the work speed of the embroidery, thereby dramatically improving work productivity.

BACKGROUND

In general, an embroidery machine is a two-axes positioning control machine in that an embroidery frame anchoring a piece of cloth horizontally moves in X- and Y-directions while a needle bar for executing a sewing operation moves vertically.

A needle bar vertical drive unit for vertically driving the needle bar is installed within the sewing arm of the embroidery machine, and an upper shaft providing force for driving the needle bar vertical drive unit is installed through the sewing arm, wherein the noise and vibration are produced most within the sewing arm when the needle bar is driven. Reducing the noise and vibration within is the most important factor in increasing the work speed of the machine.

FIG. 1 is a schematic perspective view showing a sewing arm mechanism of a conventional embroidery machine, and FIG. 2 is an exploded perspective view of the sewing arm mechanism shown in FIG. 1. A needle bar vertical drive unit for vertically driving a needle bar (not shown) with the rotational driving force of an upper shaft 2 is installed within the sewing arm 1 of the embroidery machine, and the upper shaft 2 is installed through the sewing arm 1, wherein a needle bar drive cam 4 is fitted on the periphery of the upper shaft 2.

In addition, a needle bar drive rod 3 is installed on the periphery of the needle bar drive cam 4, and the upper shaft 2 is provided with a thread take-up lever bar drive cam base 5, and a thread take-up lever drive cam 6, beyond the needle bar drive cam 4, wherein the thread take-up lever drive cam base 5 and the thread take-up lever drive cam 6 sequentially cooperate with the needle bar drive cam 4.

Because the reaction force produced due to the rotation of the needle bar drive cam 4 installed on the upper shaft 2 and formed in an eccentric configuration, and the reaction force produced due to the driving of the needle bar vertical drive unit act on the upper shaft, the needle bar vertical drive unit installed within the sewing arm 1 as described above produces vibration and noise within the sewing arm 1 when the upper shaft 2 rotates.

FIG. 3 is an upper shaft diagram showing reaction force acting on an upper shaft diagram in a conventional embroidery machine. Here, the upper shaft 2 is configured in such a manner that the reaction force, which is exerted on the upper shaft 2 as the needle bar drive cam 4 is rotated when the upper shaft 2 rotates, and the reaction force, which is exerted on the upper shaft 2 as the needle bar vertical drive unit is driven, simultaneously act on the upper shaft 2. As a result, when the rotating velocity of the upper shaft 2 is increased, substantially high load acts on the upper shaft 2, thereby producing a lot of vibration and noise within the sewing arm 1 as well as fracturing or deforming the upper shaft 2.

If vibration and noise are produced within the sewing arm 1 as mentioned above, it is difficult to increase the rotating speed of the upper shaft 2 over a predetermined level. In addition, the vibration and noise afford the upper shaft 2 high impulsive load, thereby greatly vibrating various components of the machine as well as the upper shaft 2. As a result, the endurance of the components is deteriorated.

SUMMARY

Accordingly, the present invention has been made to solve the above-mentioned problems occurring in the prior art, and the present invention provides a sewing arm mechanism of an embroidery machine capable of suppressing the occurrence of noise and vibration.

In addition, the present invention provides a sewing arm mechanism capable of increasing the sewing speed of an embroidery machine by allowing the upper shaft to rotate in high speed.

According to the present invention, there is provided a sewing arm mechanism of a embroidery machine, the sewing arm mechanism including: a needle bar vertical drive unit for vertically moving a needle bar by using a rotational driving force of an upper shaft; and a cloth pressing member vertical drive unit for vertically moving a cloth pressing member by using the rotational driving force of an upper shaft, wherein the sewing arm mechanism is configured in such a manner that the needle bar drive reaction force exerted on the upper shaft by the driving of the needle bar vertical drive unit, and the cloth pressing member drive reaction force exerted on the upper shaft by the driving of the cloth pressing member vertical drive unit act in opposite directions of each other, whereby the magnitudes of the reaction forces exerted on the upper shaft can be cancelled with each other.

Preferably, the needle bar vertical drive unit includes: a needle bar drive cam fitted on the periphery of the upper shaft; and a needle bar drive rod rotationally engaged with the outer periphery of the needle bar drive cam.

The cloth pressing member vertical drive unit may include: a cloth pressing member drive cam fitted on the periphery of the upper shaft; a cloth pressing member drive rod rotationally engaged with the outer periphery of the cloth pressing member drive cam; and a cloth pressing member drive cam base engaged with the cloth pressing member drive cam on one side of the cloth pressing member drive cam.

In addition, the cloth pressing member vertical drive unit may further include: a cloth pressing member drive cam collar engaged on the other side of the cloth pressing member drive cam, the cloth pressing member drive cam collar being formed in a shape oppositely eccentric to the eccentric direction of the needle bar drive cam.

The inventive sewing arm mechanism may further include a thread take-up lever drive cam base formed to have an eccentric direction opposite to the eccentric direction of the needle bar drive cam in weight center, thereby to correct the unbalance of the upper shaft caused by the needle bar drive reaction force or the cloth pressing member drive reaction force exerted on the upper shaft when the needle bar vertical drive unit or the cloth pressing member vertical drive unit is driven.

DRAWINGS

The above and other objects, features and advantages of the present invention will be more apparent from the following detailed description taken in conjunction with the accompanying drawings, in which.

Figure 6A:
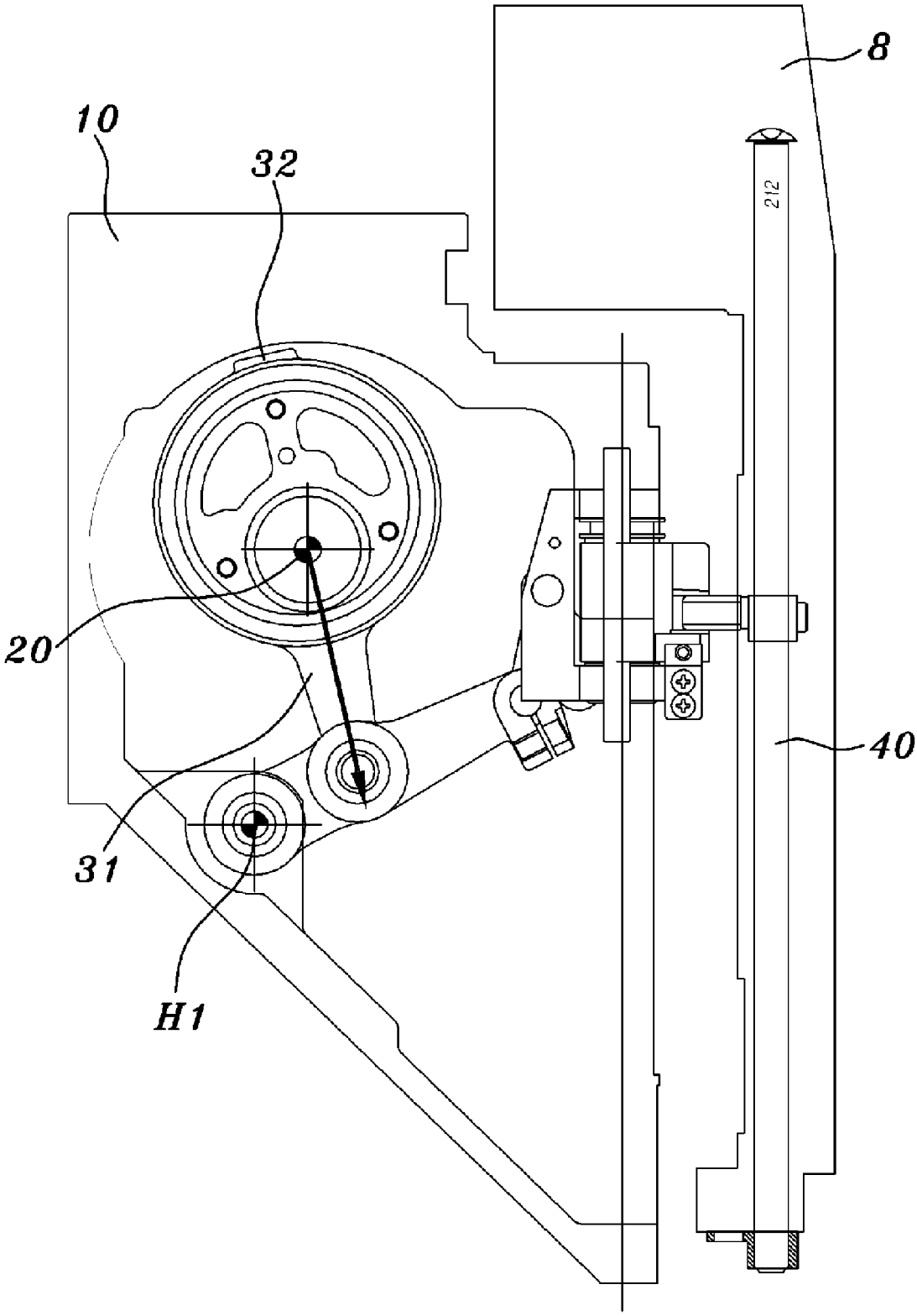
Figure 6B:
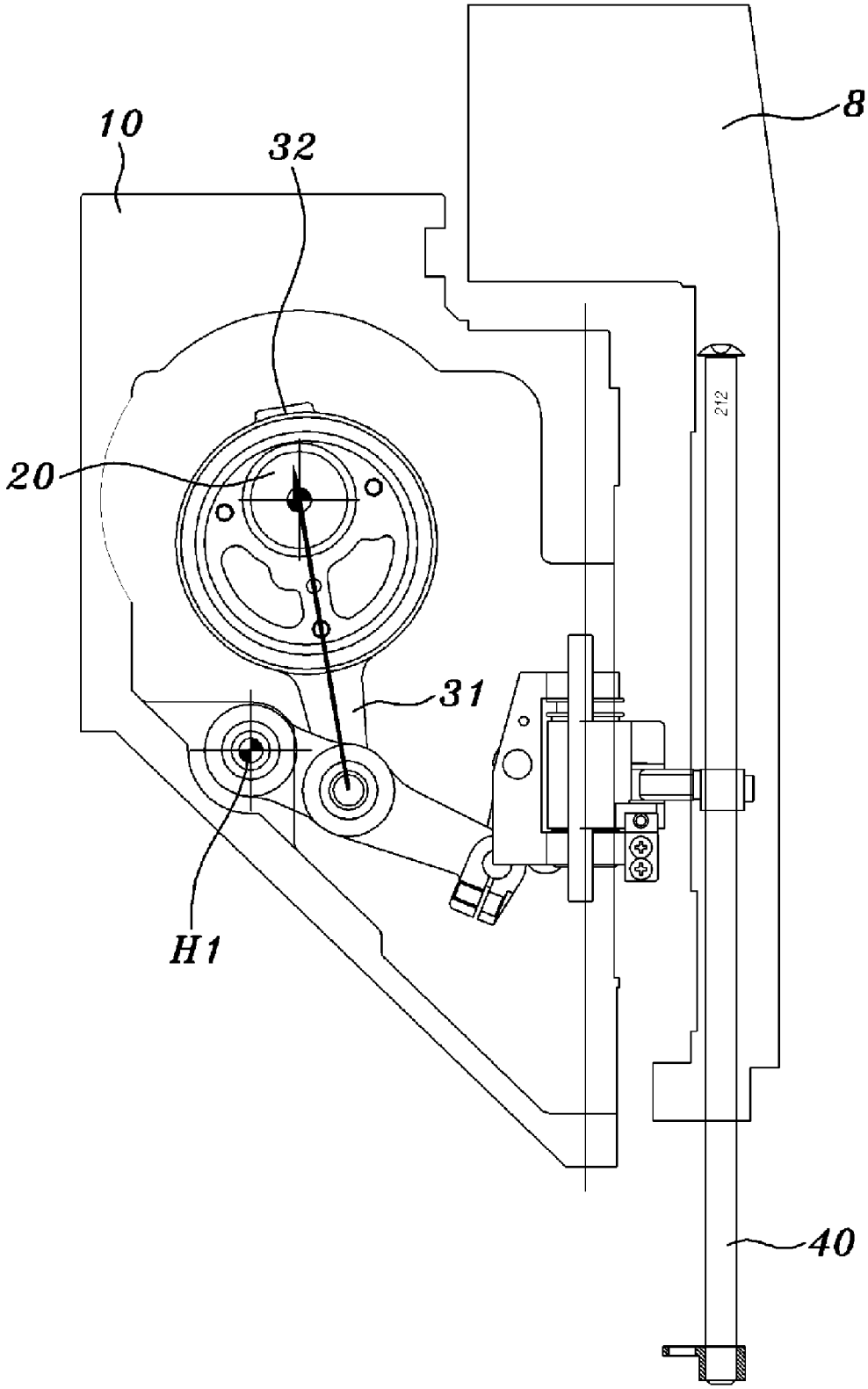
Figure 6C:
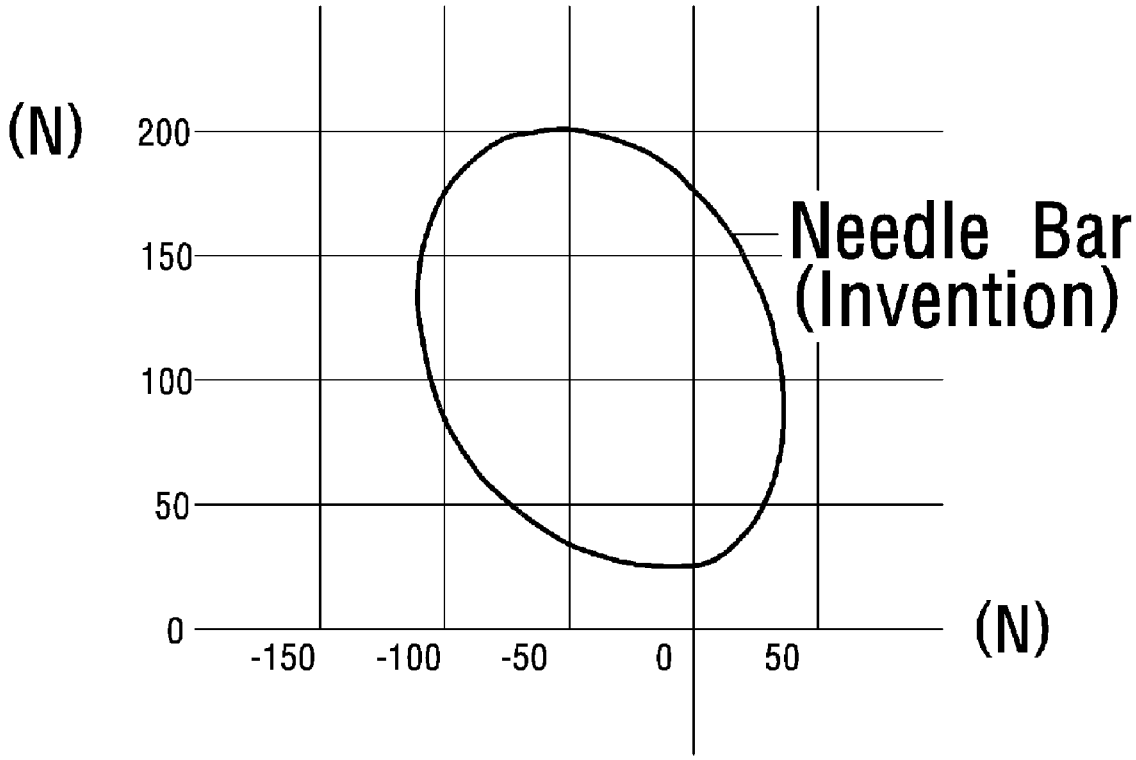
Figure 7A:
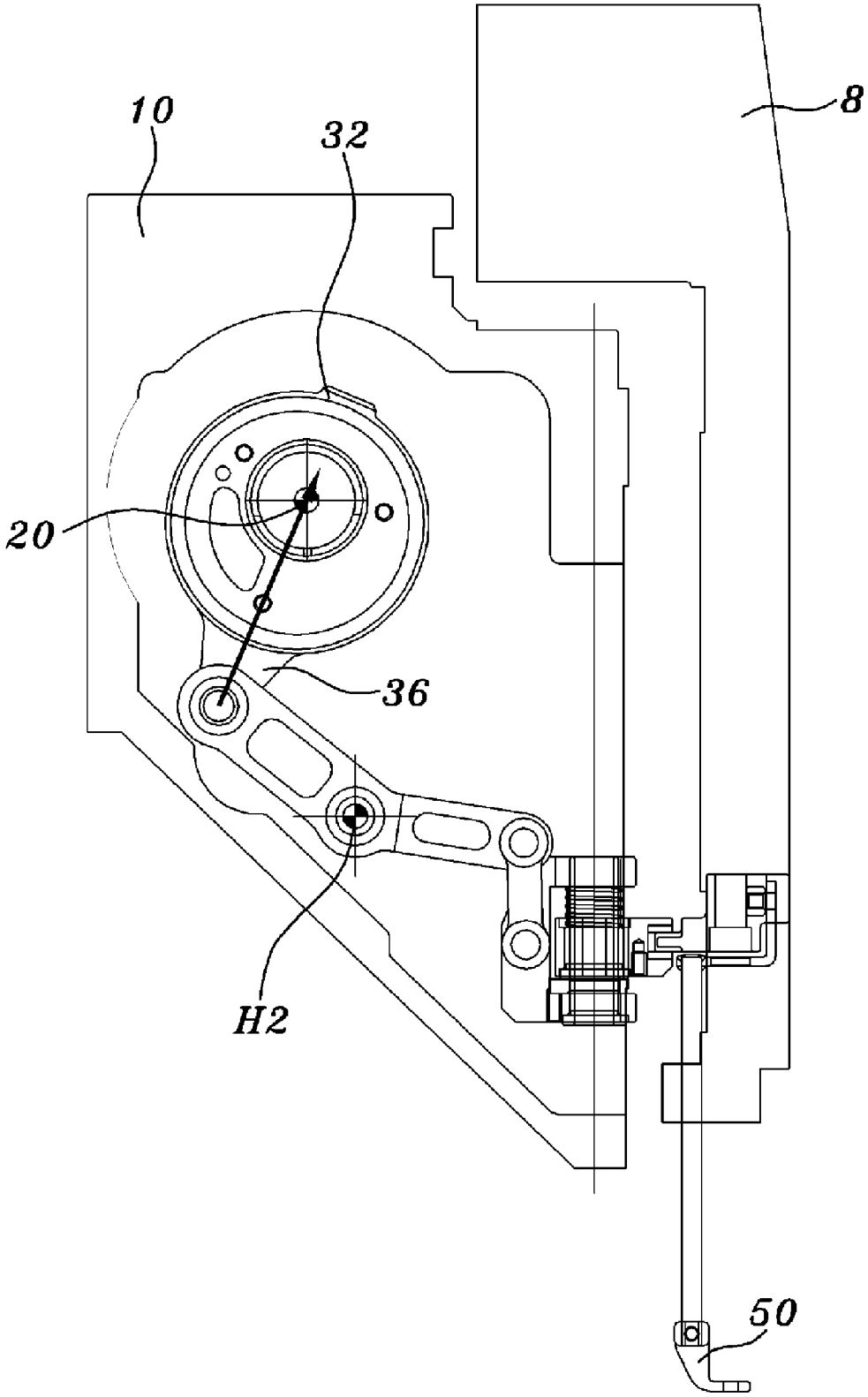
Figure 7B:
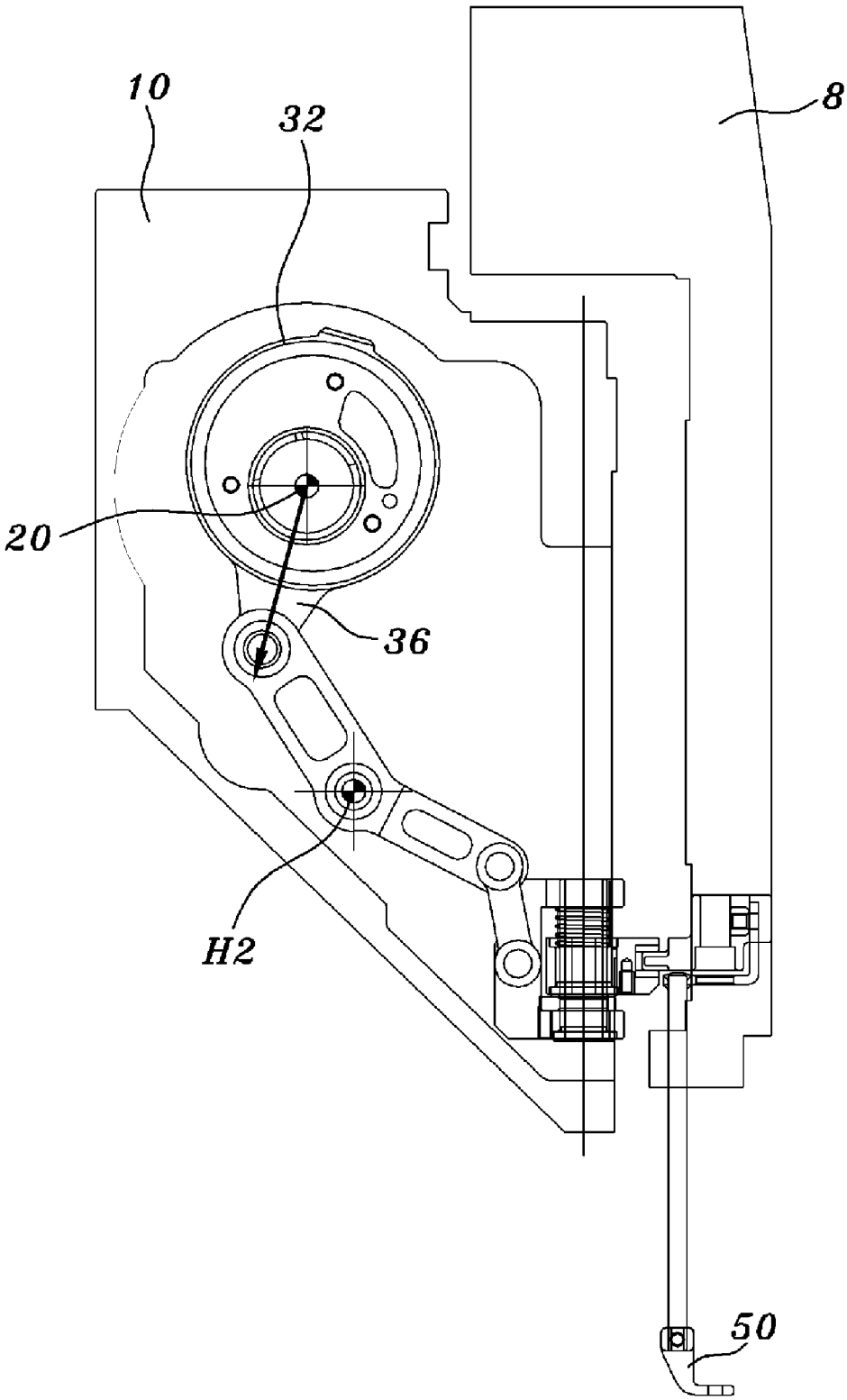
Figure 7C:
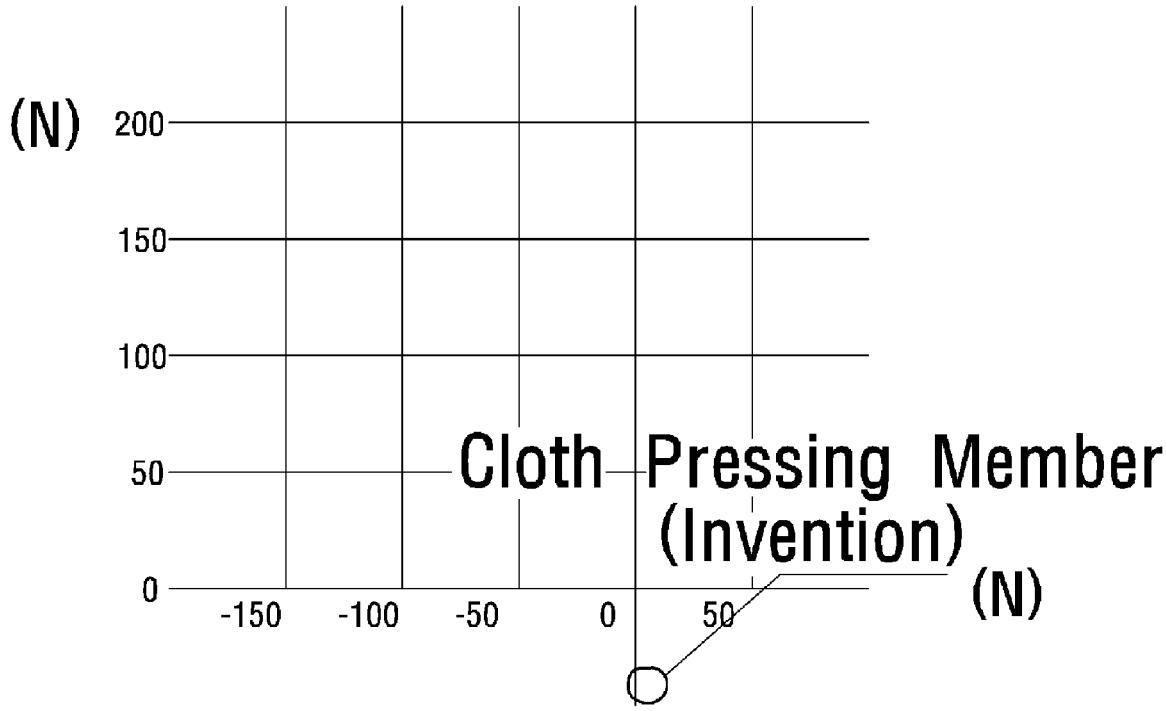
Figure 8A:
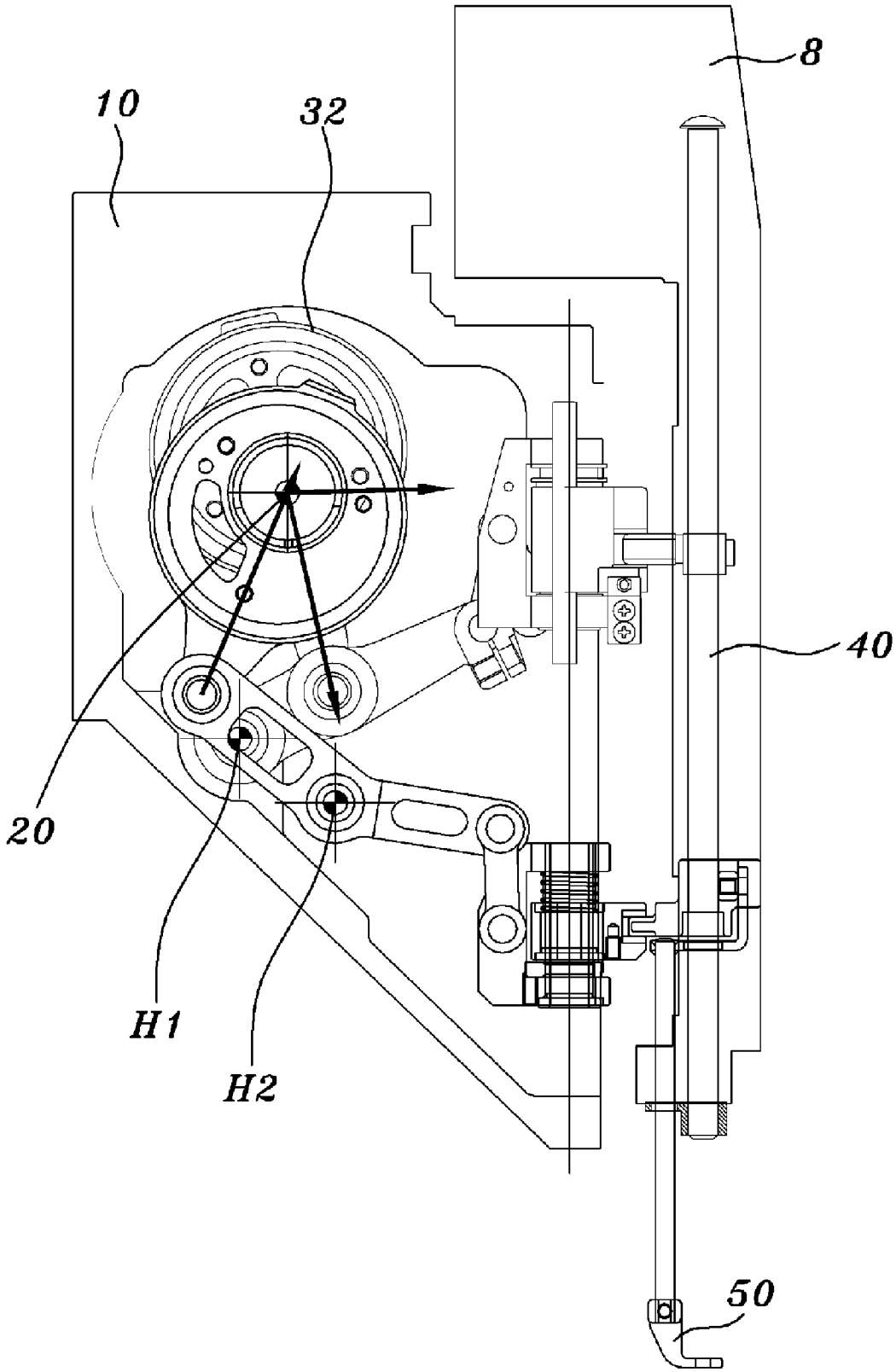
Figure 8B:
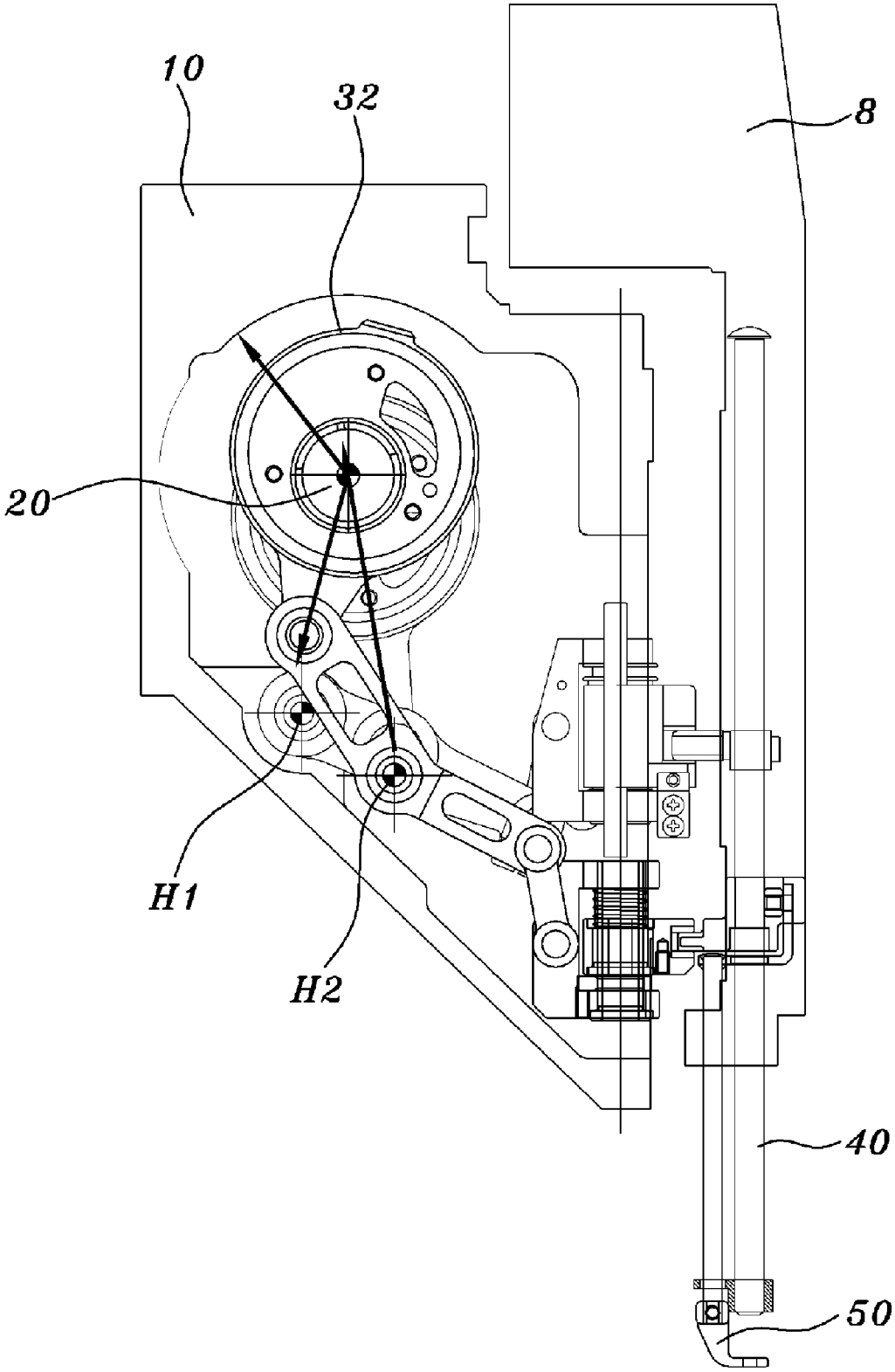
Figure 9A:
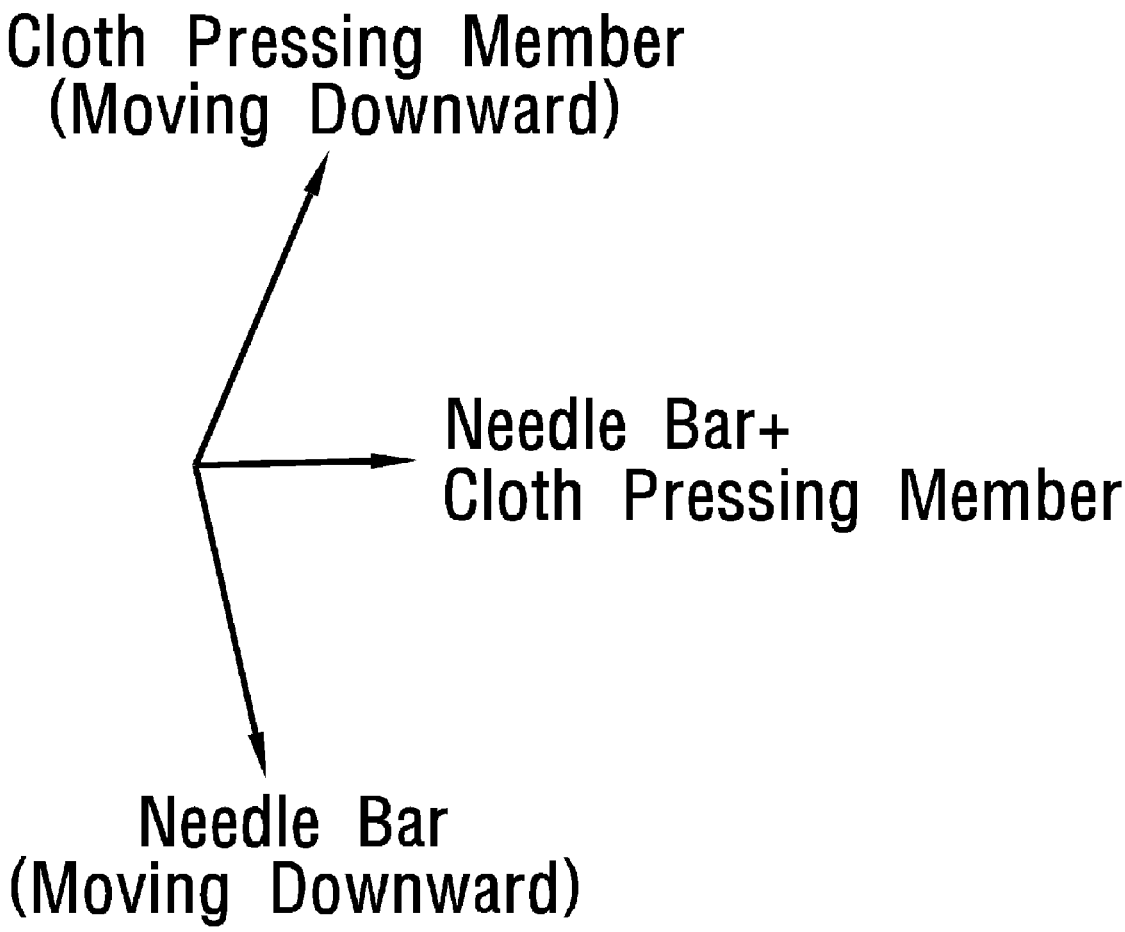
Figure 9B:
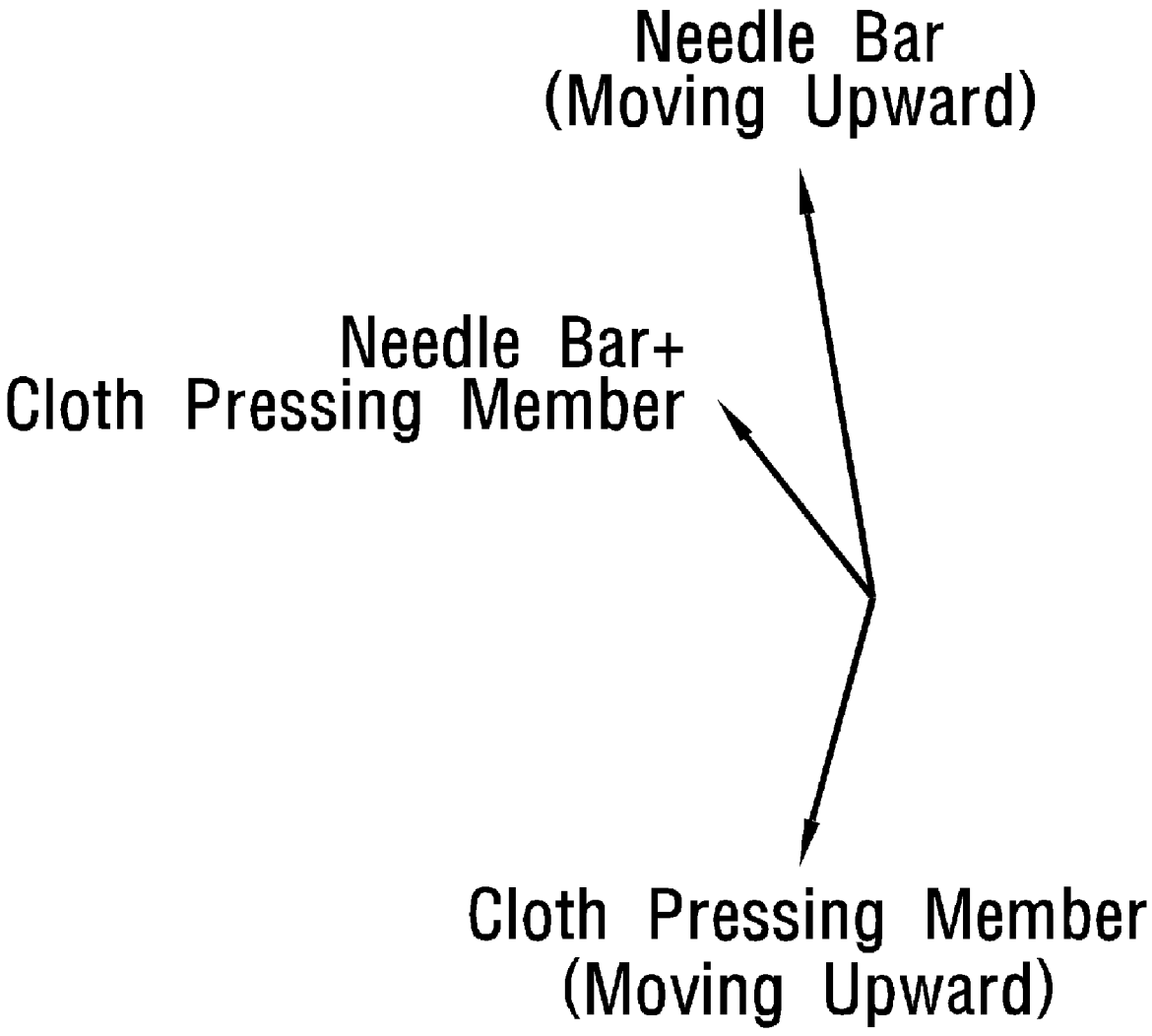
Figure 10:
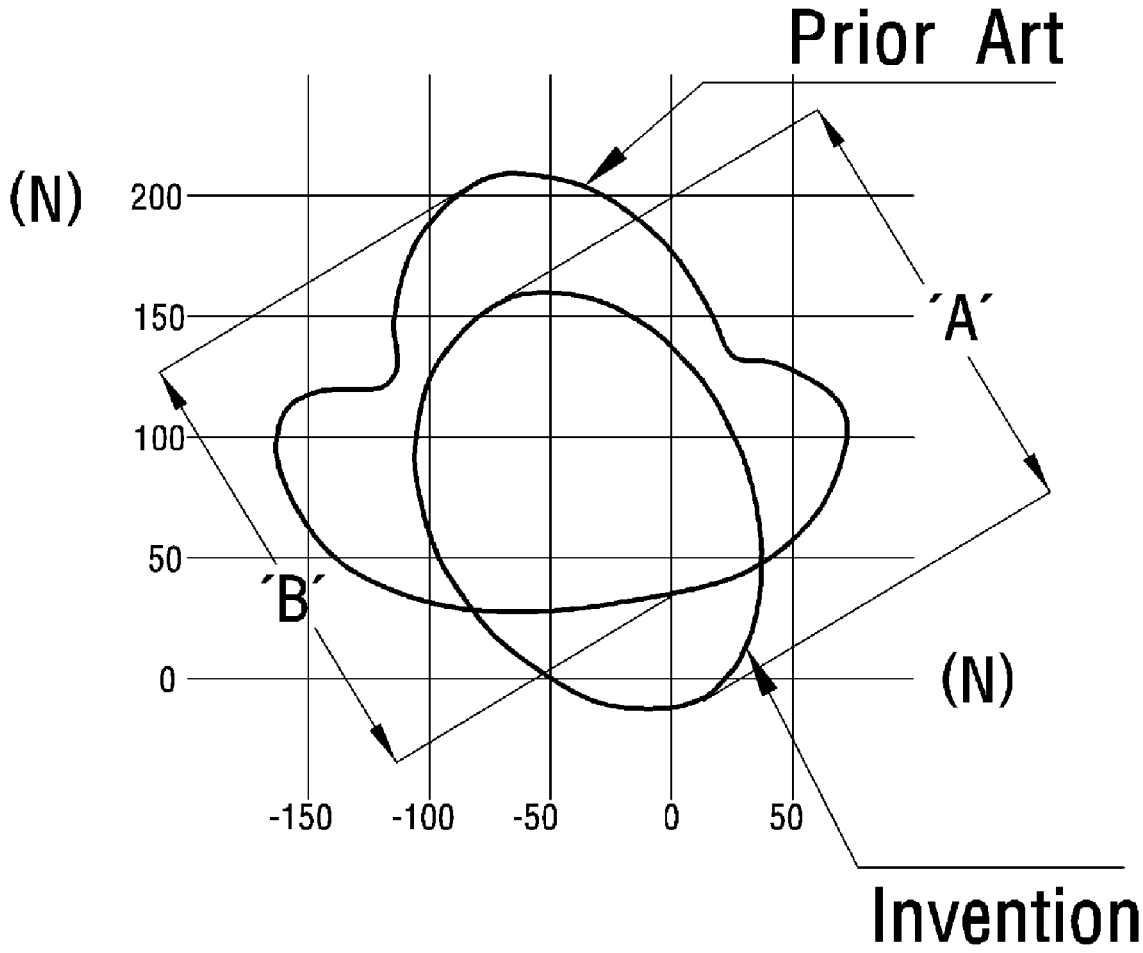

FIG. 6*a* is a side view showing a needle bar driven at the position of top dead center in the present invention;

FIG. 6*b* is a side view showing the needle bar driven at the position of bottom dead center in the present invention;

FIG. 6*c* is an upper shaft diagram according to the driving of the needle bar of the present invention;

FIG. 7*a* is a side view showing a cloth pressing member driven at the position of top dead center in the present invention;

FIG. 7*b* is a side view showing the cloth pressing member driven at the position of bottom dead center in the present invention;

FIG. 7*c* is an upper shaft diagram according to the driving of the cloth pressing member of the present invention;

FIG. 8*a* is a side view showing the needle bar and the cloth pressing member driven at the position of top dead center in the present invention;

FIG. 8*b* is a side view showing the needle bar and the cloth pressing member driven at the position of bottom dead center in the present invention;

FIG. 9*a* is a reaction force diagram showing reaction force exerted on the upper shaft by the needle drive reaction force and the cloth pressing member drive reaction at the position of top dead center in the present invention;

FIG. 9*b* is a reaction force diagram showing reaction force exerted on the upper shaft by the needle drive reaction force and the cloth pressing member drive reaction at the position of bottom dead center in the present invention; and FIG. 10 shows both upper shaft diagrams according to the driving of the needle bars and the cloth pressing bars of the present invention and the prior art.

DETAILED DESCRIPTION

Hereinafter, exemplary embodiments of the present invention will be described with reference to the accompanying drawings. Please note that the figures in the accompanying drawings are exaggerated in size for the convenience of description.

Figure 1:
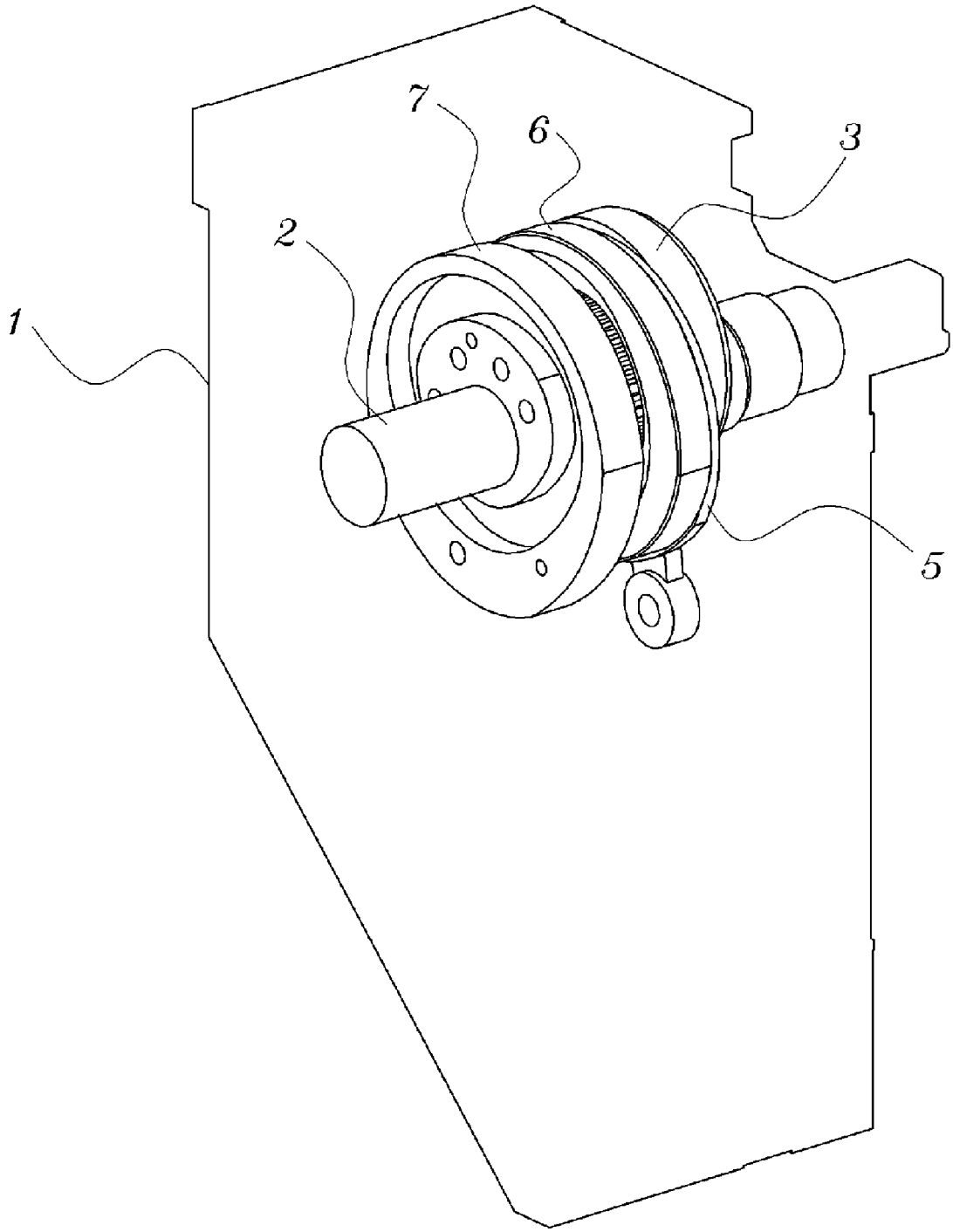
FIG. 1 is a schematic perspective view showing a sewing arm mechanism of a conventional embroidery machine.
Figure 2:
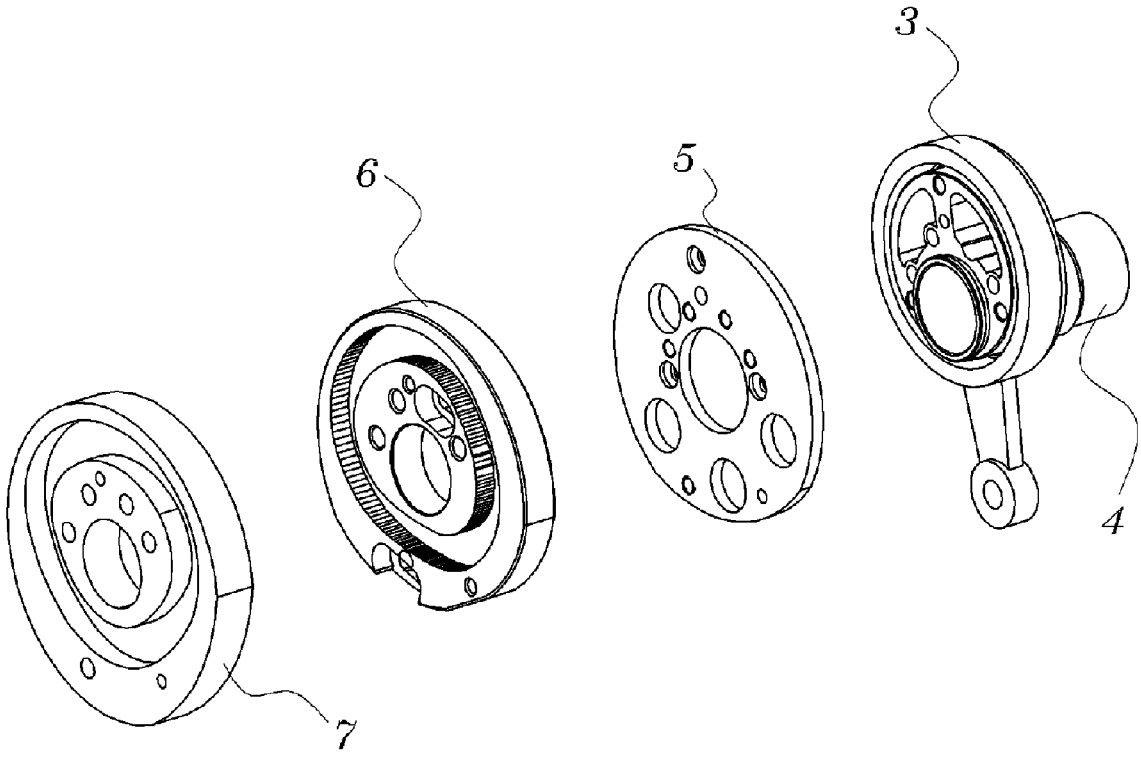
FIG. 2 is an exploded perspective view of the sewing arm mechanism shown in FIG. 1.
Figure 3:
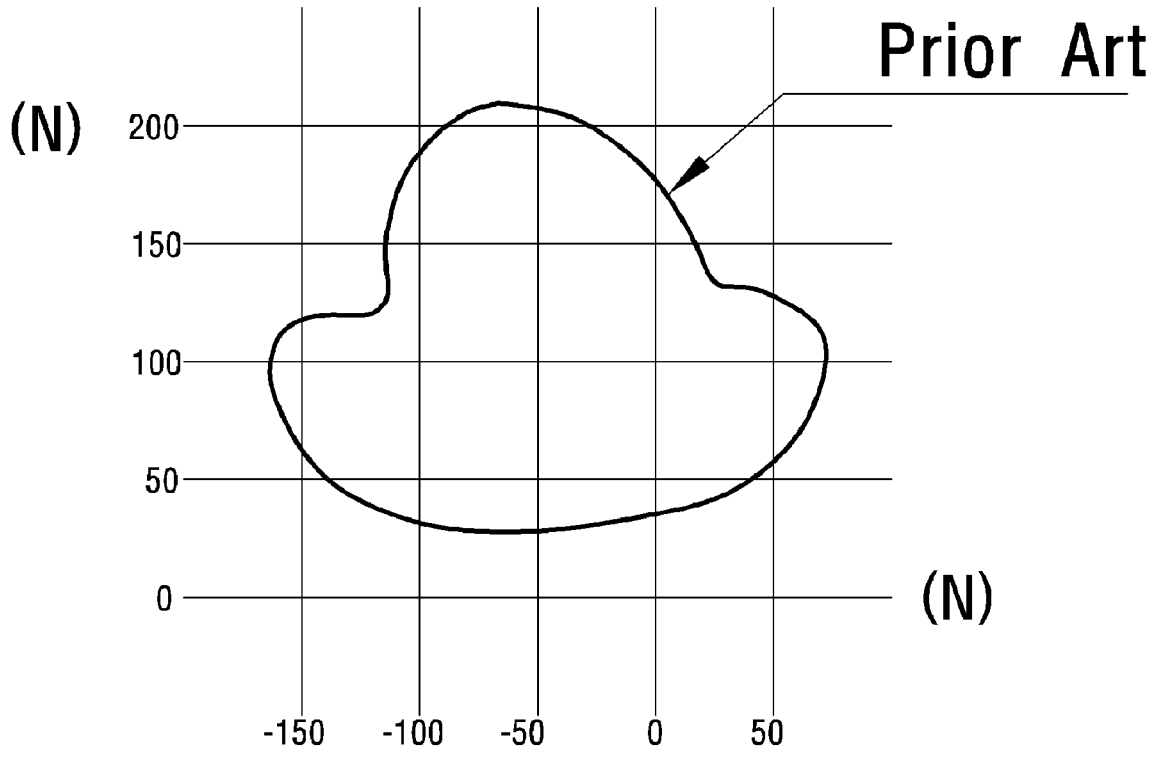
FIG. 3 is an upper shaft diagram showing reaction force acting on an upper shaft in a conventional embroidery machine.
Figure 4:
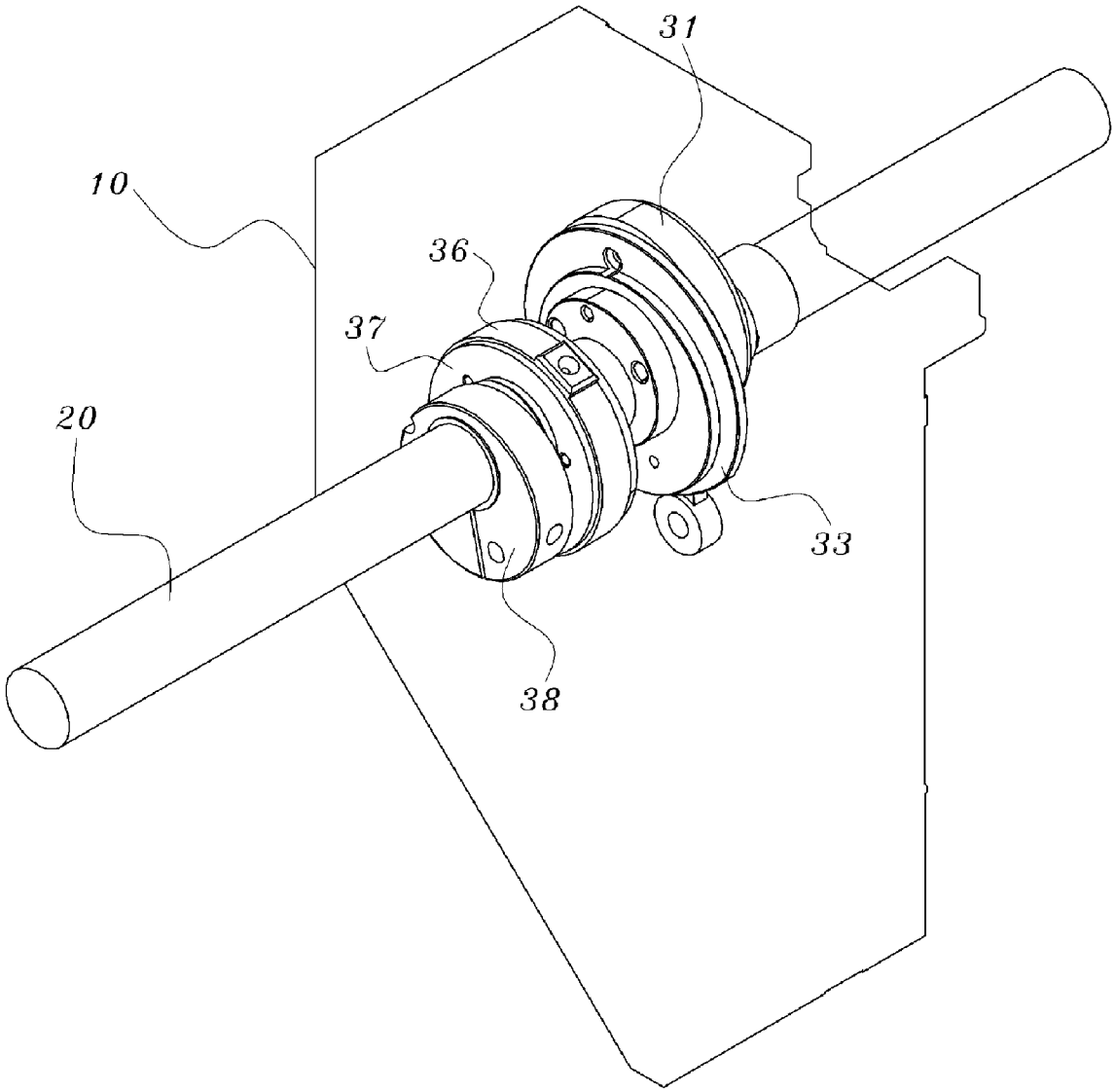
FIG. 4 is a perspective view showing a sewing arm mechanism of an embroidery machine according to an embodiment of the present invention.
Figure 5:
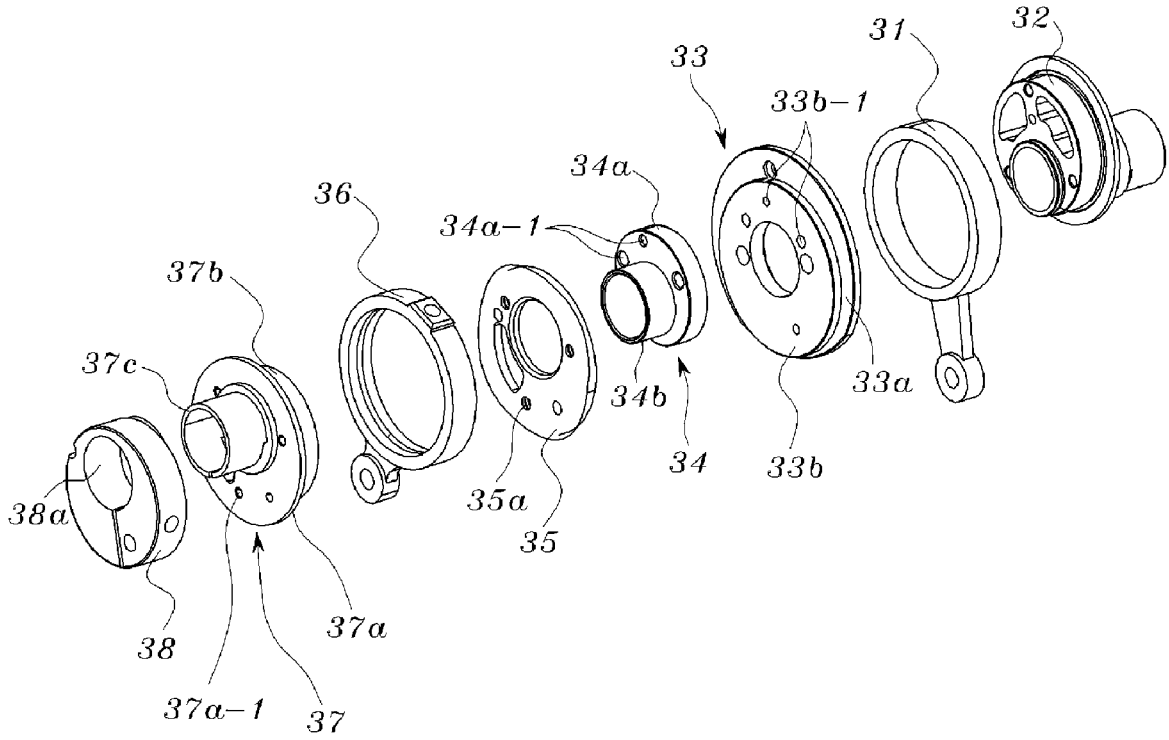
FIG. 5 is an exploded perspective view of the sewing arm mechanism shown in FIG. 4.

FIG. 4 is a perspective view showing a sewing arm mechanism of an embroidery machine according to an embodiment of the present invention, and FIG. 5 is an exploded perspective view of the sewing arm mechanism shown in FIG. 4.

As shown in the drawings, a needle bar vertical drive unit for vertically moving a needle bar 40 (see FIG. 6*a*) by using the rotational driving force of an upper shaft 20 and a cloth pressing member vertical drive unit for vertically moving a cloth pressing member 50 (see FIG. 7*a*) are installed within the sewing arm 10.

At this time, the needle bar vertical drive unit is rotated by the driving force of a drive motor (not shown), wherein an eccentric needle bar drive cam 32 is fitted on the periphery of an upper shaft 20 installed through the sewing arm 10, and the internal periphery of a needle bar drive rod 31 is rotationally engaged with the outer periphery of the needle bar drive cam 32.

In addition, beyond the needle bar drive cam 32, a thread take-up lever drive cam 34 and a thread take-up lever drive cam base 33 are installed on the periphery of the upper shaft 20 to be continuously abutted against one another.

The thread take-up lever drive cam 34 is formed from a steel material generally in a "T" shaped cross-section, wherein the thread take-up lever drive cam 34 includes a drive cam body 34*a* formed in a ring shape with a predetermined thickness, and a cylindrical extension 34*b* positioned adjacent to a side of the drive cam body 34*a* and communicating with the drive cam body 34*a*. Along the circumferential direction of the inner side of the drive cam body 34*a*, a plurality of through-holes 34*a*-1 are formed, which are assembled with a plurality of screw holes 33*b*-1 of the thread take-up lever drive cam base 33 (to be described later) by screws, and the thread take-up lever drive cam 34 is fitted on the periphery of the upper shaft 20 through the communicating part.

Meanwhile, it is possible to install at least one thread take-up lever drive cam base 33 on a side of the thread take-up lever drive cam 34 so as to correct unbalance caused by the rotation of the upper shaft 20, wherein the drive cam base 33 is generally formed in a stepped indeterminate shape with a ring-shaped extension 33*b* being formed on a side of a ring-shaped base body 33*a* in such a manner that the former communicates with the latter, and a plurality of screw holes 33*b*-1 communicating with the through-holes 34*a*-1 of the thread take-up lever drive cam 34 are formed on the inner side of the extension 33*b*. The thread take-up lever drive cam base 33 is fitted on the periphery of the upper shaft 20 to be continuously abutted against the needle bar drive rod 31.

The thread take-up lever drive cam base 33 is formed in such a manner that its weight center is opposed to the weight center of the needle bar drive cam 32, so that when the needle bar vertical drive unit or the cloth pressing member vertical drive unit is driven, the unbalance of the upper shaft 20 caused by the needle bar drive reaction force or the cloth pressing member drive reaction force exerted on the upper shaft 20 can be corrected (to be described later). The thread take-up lever drive cam base 33 may be integrally formed with the thread take-up lever drive cam 34.

The cloth pressing member vertical drive unit includes a cloth pressing member drive cam base 35 and a cloth pressing member drive cam 37 which are assembled with each other with a cloth pressing member drive rod 36 being interposed between the cloth pressing member drive cam base 35 and the cloth pressing member drive cam 37, wherein the cloth pressing member drive cam base 35 is formed in a ring shape to be mounted on the periphery of the upper shaft 20, and has a plurality of screw holes 35*a* formed along the periphery of the inner side thereof.

The cloth pressing member drive cam 37 is fitted on the periphery of the upper shaft 20, wherein the cloth pressing member drive cam 37 has a drive cam body 37*a* formed in a ring shape and having a plurality of screw holes 37*a*-1 along the periphery of the inner side thereof, which communicate with the screw holes 35*a* of the cloth pressing member drive cam base 35, a hollow cylindrical insertion part 37*b* projecting from one side of the drive cam body 37*a*, and a cylindrical projection 37*c* being formed on the other side of the drive cam body 37*a*, so that the insertion part 37*b* is inserted into the cloth pressing member drive rod 36 and then the screw holes 35*a* and 37*a*-1 are screwed with each other.

The cloth pressing member drive cam 37 is generally formed in an eccentric configuration, and the cloth pressing member drive rod 36 rotationally fitted on the outer periphery of the cloth pressing member drive cam 37 is vertically moved as the cloth pressing member drive cam 37 rotates.

Meanwhile, the inventive cloth pressing member vertical drive unit further includes a cloth pressing member driving cam collar 38 on the other side thereof, wherein the cloth pressing member drive cam collar 38 is formed in a configuration oppositely eccentric to the eccentric direction of the needle bar drive cam 32. The cloth pressing member drive cam collar 38 is fitted on the outer periphery of the projection 37*c* of the cloth pressing member drive cam 37 through a through-hole 38*a* formed through the collar 38.

Now, the action of the present invention configured as described above will be described.

As shown in FIGS. 4 and 5, if the upper shaft 20 is rotated by receiving power from the drive motor, the needle bar drive cam 32 is rotated by the rotating force of the upper shaft 20, and the needle bar drive rod 31 is vertically moved in cooperation with the needle bar drive cam 32. In addition, a needle bar 40 installed to be vertically movable on a needle bar support case 8 (see FIG. 6*a*) is vertically moved in response to the driving of the needle bar drive rod 31.

In addition, if the thread take-up lever drive cam 34 and the cloth pressing member drive cam 37 fitted on the periphery of the upper shaft 20 are rotated synchronously with the upper shaft 20, a thread take-up lever (not shown) and the cloth pressing member 50 are vertically moved in response to the rotation of the thread take-up lever drive cam 34 and the cloth pressing member drive cam 37.

In this procedure, because the thread take-up lever drive cam base 33 with an indeterminate shape is arranged in such a manner that its eccentric direction is opposed to the eccentric direction of the needle bar drive cam 32 in terms of weight center, it is possible to correct the unbalance of the upper shaft caused by the needle bar drive reaction force or the cloth pressing member drive reaction force exerted on the upper shaft 20 when the needle bar vertical drive unit or the cloth pressing member vertical drive unit is driven.

That is, because the weight center of the needle bar drive cam 32 is eccentric to a side, and the weight centers of the thread take-up lever drive cam base 33 and the cloth pressing member drive cam 37 are oppositely eccentric to the needle bar drive cam 32, the needle bar drive reaction force and the cloth pressing member drive reaction force produced in the process of rotating the upper shaft 20 and exerted on the upper shaft 20 are cancelled with each other, thereby reducing the occurrence of noise and vibration in the sewing arm 10.

FIG. 6*a* is a side view showing the needle bar driven at the position of top dead center in the present invention, and FIG. 6*b* is a side view showing the needle bar driven at the position of bottom dead center in the present invention. As shown in the drawings, while being vertically driven, the needle bar 40 connected to the needle bar drive rod 31 reciprocates about a hinge point H1 with a relatively large stroke from the top dead center to the bottom dead center. At this time, the needle bar drive reaction force produced by the driving of the needle bar vertical drive unit acts downward at the top dead center and acts upward at the bottom dead center.

FIG. 6*c* is an upper shaft diagram according to the driving of the needle bar of the present invention. When the needle bar vertical drive unit is only operated, the reaction force exerted on the upper shaft 20 has an even stress distribution in an egg shape not less than a predetermined numerical value with reference to the center (0) of the upper shaft, thereby being indicated in a pattern biased to a position, which means that the upper shaft 20 vibrates in a predetermined direction.

Meanwhile, FIG. 7*a* is a side view showing the cloth pressing member driven at the position of top dead center in the present invention, and FIG. 7*b* is a side view showing the cloth pressing member driven at the position of bottom dead center in the present invention.

As shown in the drawing, the cloth pressing member drive rod 36 and the cloth pressing member drive cam 37 are rotated about the upper shaft 20 according to the rotation of the upper shaft 20, and the cloth pressing member 50 also vertically reciprocates in response to the rotation of the cloth pressing member drive cam 37.

That is, the cloth pressing member 50 connected to the cloth pressing member drive rod 36 reciprocates with a stroke smaller than the stroke of the needle bar 40 from the top dead center to the bottom dead center about a hinge point H2. At this time, the cloth pressing member drive reaction force produced by the driving of the cloth pressing member vertical drive unit acts upward at the top dead center and acts downward at the bottom dead center.

FIG. 7*c* is an upper shaft diagram according to the driving of the cloth pressing member of the present invention. When the cloth pressing member vertical drive unit is only operated, the reaction force exerted on the upper shaft 20 has an even stress distribution in a circular shape not less than a predetermined numerical value with reference to the center (0) of the upper shaft, thereby being indicated in a pattern biased to a position, which means that the upper shaft is vibrated in a predetermined direction by the cloth pressing member drive reaction force.

When FIG. 6*c* and FIG. 7*c* are compared with each other, the needle bar drive reaction force exerted on the upper shaft 20 when the needle bar vertical drive unit is only operated is relatively larger than the cloth pressing member drive reaction force exerted on the upper shaft when the cloth pressing member vertical drive unit is only operated. However, because the needle bar drive reaction force and the cloth pressing member drive reaction force are distributed in different areas with reference to the center (0) of the upper shaft, it can be confirmed that the acting directions thereof are opposite to each other.

FIG. 8*a* is a side view showing the needle bar and the cloth pressing member driven at the position of top dead center in the present invention, and FIG. 8*b* is a side view showing the needle bar and the cloth pressing member driven at the position of bottom dead center in the present invention.

In addition, FIG. 9*a* is a reaction force diagram showing reaction force exerted on the upper shaft by the needle drive reaction force and the cloth pressing member drive reaction at the position of top dead center in the present invention, and FIG. 9*b* is a reaction force diagram showing reaction force exerted on the upper shaft by the needle drive reaction force and the cloth pressing member drive reaction at the position of bottom dead center in the present invention.

The characteristic feature of the present invention is closely related to the hinge point H1 of the needle bar vertical drive unit and the hinge point H2 of the cloth pressing member vertical drive unit, wherein in order to lower the needle bar 40 from the top dead center, the needle bar vertical drive unit exerts reaction force rendering a needle bar drive lever (not shown) to downwardly act on the upper shaft 20 with reference to the hinge point H1.

In contrast, in order to lower the cloth pressing member 50 from the top dead center, the cloth pressing member vertical drive unit exerts reaction force rendering a cloth pressing member drive lever (not shown) to upwardly act on the upper shaft 20 with reference to the hinge point H2.

As a result, the drive reaction force produced when the cloth pressing member 50 is vertically driven with reference to the hinge point H2 acts on the upper shaft 20 in the direction opposite to the drive reaction force produced when the needle bar 40 is vertically driven with reference to the hinge point H1, whereby the magnitudes of the needle bar drive reaction force and the cloth pressing member drive reaction force exerted on the upper shaft 20 according to the driving of the needle bar 40 and the cloth pressing member 50 can be cancelled with each other.

FIG. 10 shows both upper shaft diagrams according to the driving of the needle bars and the cloth pressing bars of the present invention and the prior art. From the drawing, it can be confirmed that when the needle bar 40 and the cloth pressing member 50 are vertically driven, the reaction forces exerted on the upper shaft 20 are cancelled with each other, whereby the maximum value A of the sum of the needle bar drive reaction force and the cloth pressing member drive reaction force becomes smaller than the maximum value B of the sum of the forces exerted on the upper shaft 20 in the prior art.

In addition, according to the prior art, because the reaction force acting range is deviated from the center (0 point) of the upper shaft, unbalancing occurs when the upper shaft 20 rotates. However, according to the present invention, because the reaction force acting area is evenly distributed in an oval shape about the center (0 point) of the upper shaft 20, balancing evenly occurs when the upper shaft 20 rotates.

Meanwhile, according to the prior art, the solid line area indicated in a "U" shape about the point (−50, 150) corresponds to reaction force exerted on the upper shaft 2, and the solid line area indicated substantially in a pot shape about the point (−50, 150) corresponds to the reaction force exerted on the upper shaft 2 when the cloth pressing member drive cam 7.

As shown in the drawing, it can be appreciated that according to the prior art, the acting ranges of the reaction forces exerted on the upper shaft 2 by the needle bar drive cam 4 and the cloth pressing member drive cam 7 are unevenly presented.

According to the present invention, two types of reaction forces produced when the needle bar vertical drive unit and the cloth pressing member vertical drive unit by the rotating drive force of the upper shaft within the sewing arm of the embroidery machine acting on the upper shaft act opposite to each other. As a result, the reaction forces exerted on the upper shaft are cancelled with each other, so that the noise and vibration occurring within the sewing arm of the embroidery machine when the needle bar vertical drive unit and the cloth pressing member vertical drive unit are driven.

Furthermore, because it is possible to drive the needle bar vertical drive unit and the cloth pressing member vertical drive unit in high speed within the sewing arm of the embroidery machine due to the above-mentioned effect, the work speed of the embroidery machine can be increased, thereby dramatically improving the productivity.

Although several exemplary embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A sewing arm mechanism of an embroidery machine, the sewing arm mechanism comprising:

a needle bar vertical drive unit for vertically moving a needle bar by using a rotational driving force of an upper shaft;

a cloth pressing member vertical drive unit for vertically moving a cloth pressing member by using the rotational driving force of an upper shaft: and a thread take-up lever drive cam base formed to have an eccentric direction opposite to the eccentric direction of the needle bar drive cam in weight center, thereby to correct the unbalance of the upper shaft caused by the needle bar drive reaction force or the cloth pressing member drive reaction force exerted on the upper shaft when the needle bar vertical drive unit or the cloth pressing member vertical drive unit is driven, wherein the sewing arm mechanism is configured in such a manner that the needle bar drive reaction force exerted on the upper shaft by the driving of the needle bar vertical drive unit, and the cloth pressing member drive reaction force exerted on the upper shaft by the driving of the cloth pressing member vertical drive unit act in opposite directions of each other, whereby the magnitudes of the reaction forces exerted on the upper shaft can be cancelled with each other, wherein the needle bar vertical drive unit comprises: a needle bar drive cam fitted on the periphery of the upper shaft; and a needle bar drive rod rotationally engaged with the outer periphery of the needle bar drive cam, wherein the cloth pressing member vertical drive unit comprises: a cloth pressing member drive cam fitted on the periphery of the upper shaft; a cloth pressing member drive rod rotationally engaged with the outer periphery of the cloth pressing member drive cam; a cloth pressing member drive cam base engaged with the cloth pressing member drive cam on one side of the cloth pressing member drive cam, and wherein the cloth pressing member vertical drive unit further comprises: a cloth pressing member drive cam collar engaged on the other side of the cloth pressing member drive cam, the cloth pressing member drive cam collar being formed in a shape oppositely eccentric to the eccentric direction of the needle bar drive cam fitted on the periphery of the upper shaft.

* * * * *